US007222472B2

(12) United States Patent
Spatafora et al.

(10) Patent No.: US 7,222,472 B2
(45) Date of Patent: May 29, 2007

(54) METHOD OF CHECKING WRAPPING MATERIAL IN A PACKAGING MACHINE

(75) Inventors: Mario Spatafora, Bologna (IT); Bruno Tommasini, Bologna (IT)

(73) Assignee: G.D S.p.A., Bologna (IT)

( * ) Notice: Subject to any disclaimer, the term of this patent is extended or adjusted under 35 U.S.C. 154(b) by 423 days.

(21) Appl. No.: 10/636,536

(22) Filed: Aug. 8, 2003

(65) Prior Publication Data

US 2004/0029693 A1 Feb. 12, 2004

(30) Foreign Application Priority Data

Aug. 8, 2002 (IT) ..... BO2002A0529

(51) Int. Cl.
*B65B 57/02* (2006.01)
*B26D 7/27* (2006.01)

(52) U.S. Cl. ..... 53/505; 53/466; 53/396

(58) Field of Classification Search ..... 53/466, 53/586, 268, 396, 505, 65, 129.1, 131.5, 53/135.3

See application file for complete search history.

(56) References Cited

U.S. PATENT DOCUMENTS 3,960,303 A 6/1976 Gatti et al.
5,056,646 A * 10/1991 Kisler ..... 198/341.07
5,900,218 A 5/1999 LaRose et al.

FOREIGN PATENT DOCUMENTS

| | | |
|---|---|---|
| EP | 0722898 | 7/1996 |
| GB | 643794 | 9/1950 |
| WO | 02064470 | 8/2002 |

OTHER PUBLICATIONS

European Search Report dated Dec. 18, 2003.

* cited by examiner

*Primary Examiner*—Rinaldi I. Rada
*Assistant Examiner*—John Paradiso
(74) *Attorney, Agent, or Firm*—Timothy J. Klima

(57) ABSTRACT

Wrapping material utilized by a packaging machine is advanced along a set feed path through a station where an accessory material, typically adhesive, is applied in spots to selected areas of the surface, whereupon the material is charged electrostatically at a first station, and thereafter sensed at a second station to reveal the distribution of the charges; the electrostatic charges register more strongly on and around the spots, so that by measuring any variation in strength relative to the remainder of the surface, identifiable with faulty application of the adhesive, substandard material can be detected before it reaches the wrapping stations of the machine.

14 Claims, 5 Drawing Sheets

METHOD OF CHECKING WRAPPING MATERIAL IN A PACKAGING MACHINE

This application claims priority to Italian Patent Application No. BO 2002A 000529, filed Aug. 8, 2002 which is incorporated by reference herein.

BACKGROUND OF THE INVENTION

The present invention relates to a method of checking wrapping material in a packaging machine.

In particular, the invention relates to wrapping material of the type decoiled from a roll and fed to a processing station in the form of a continuous strip, or of discrete lengths separated previously at a cutting station, also to wrapping material procured in the form of blanks taken from a stack.

It is normal for such materials, before entering a first station of a machine where they are wrapped around the respective products being packaged, to undergo an operation in which accessory materials are applied to selected areas.

Depending on the particular requirements, these accessory materials can take the form of adhesives, inks, and metallic powders utilized for example in combination with adhesive substances.

In accordance with conventional techniques, the accessory materials in question must be applied to selected areas of the wrapping material and can be distributed in different ways. They can appear for example as spots, or as continuous or discontinuous stripes, or in other specific patterns.

Clearly, the distribution of accessory materials in this manner must be repeated cyclically on each length of wrapping material destined to provide a single wrapper, and similarly, the geometry of the distribution must remain identical for each such length.

If this is not the case, the steps of wrapping and packaging the finished product could give rise to structural or visual defects necessitating the rejection of the substandard products at a point downstream of the wrapping stations.

The object of the present invention is to provide a method of checking wrapping materials, generally considered, whereby the correct distribution of accessory materials can be verified upstream of the wrapping stations and the above noted problems duly overcome.

SUMMARY OF THE INVENTION

The stated object is realized according to the present invention with the adoption of a method for checking wrapping material in a packaging machine, comprising the steps of advancing the wrapping material along a predetermined feed path, applying an accessory material to selected areas of the wrapping material, charging the wrapping material electrostatically as it passes through at least one first charging station, and subsequently verifying the distribution of the electrostatic charge on the wrapping material as it passes through at least one second checking station.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
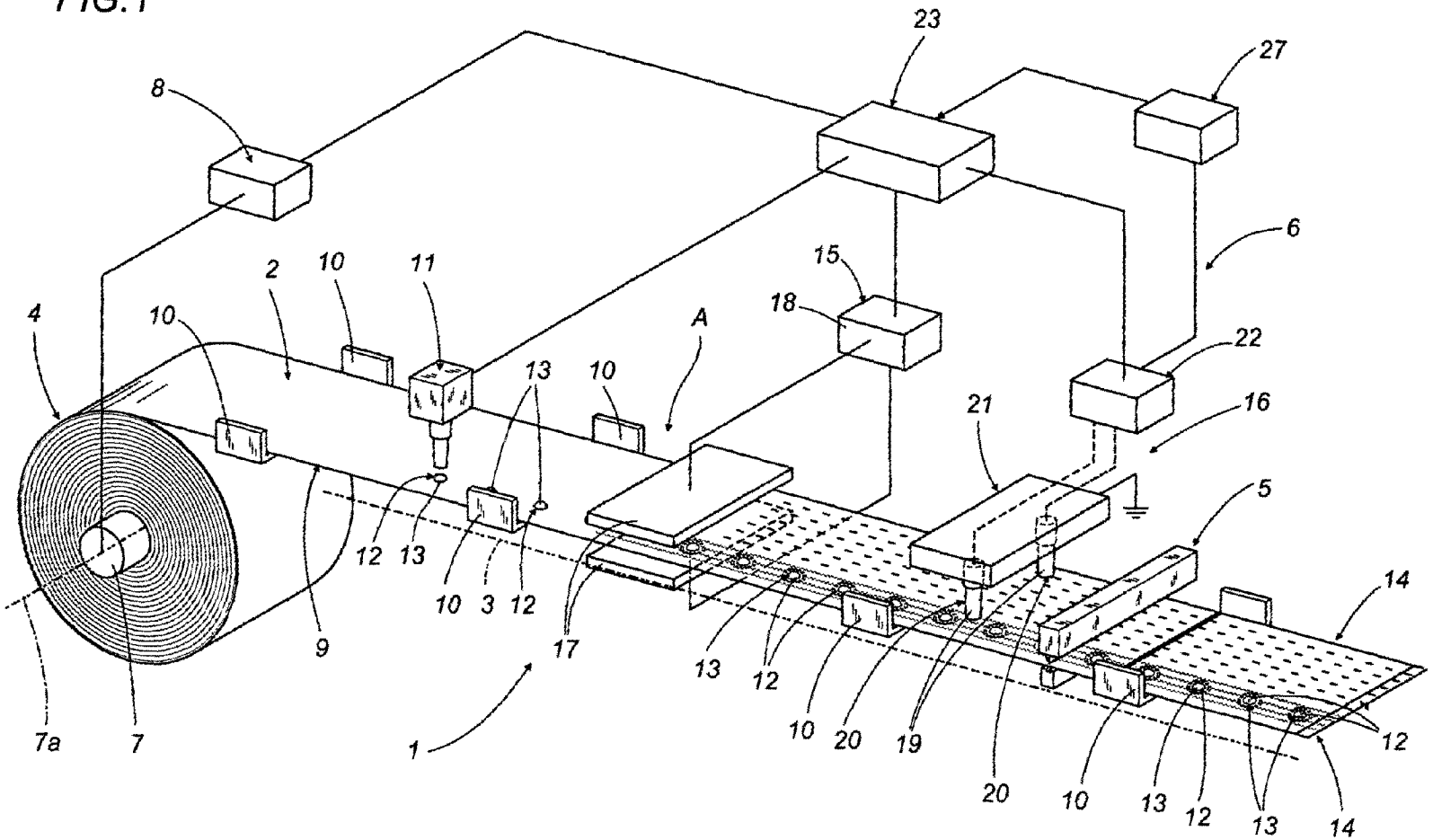
FIG. 1 shows a portion of a packaging machine equipped with a checking device embodied according to the present invention, illustrated schematically and in perspective with certain parts omitted.
Figure 2:
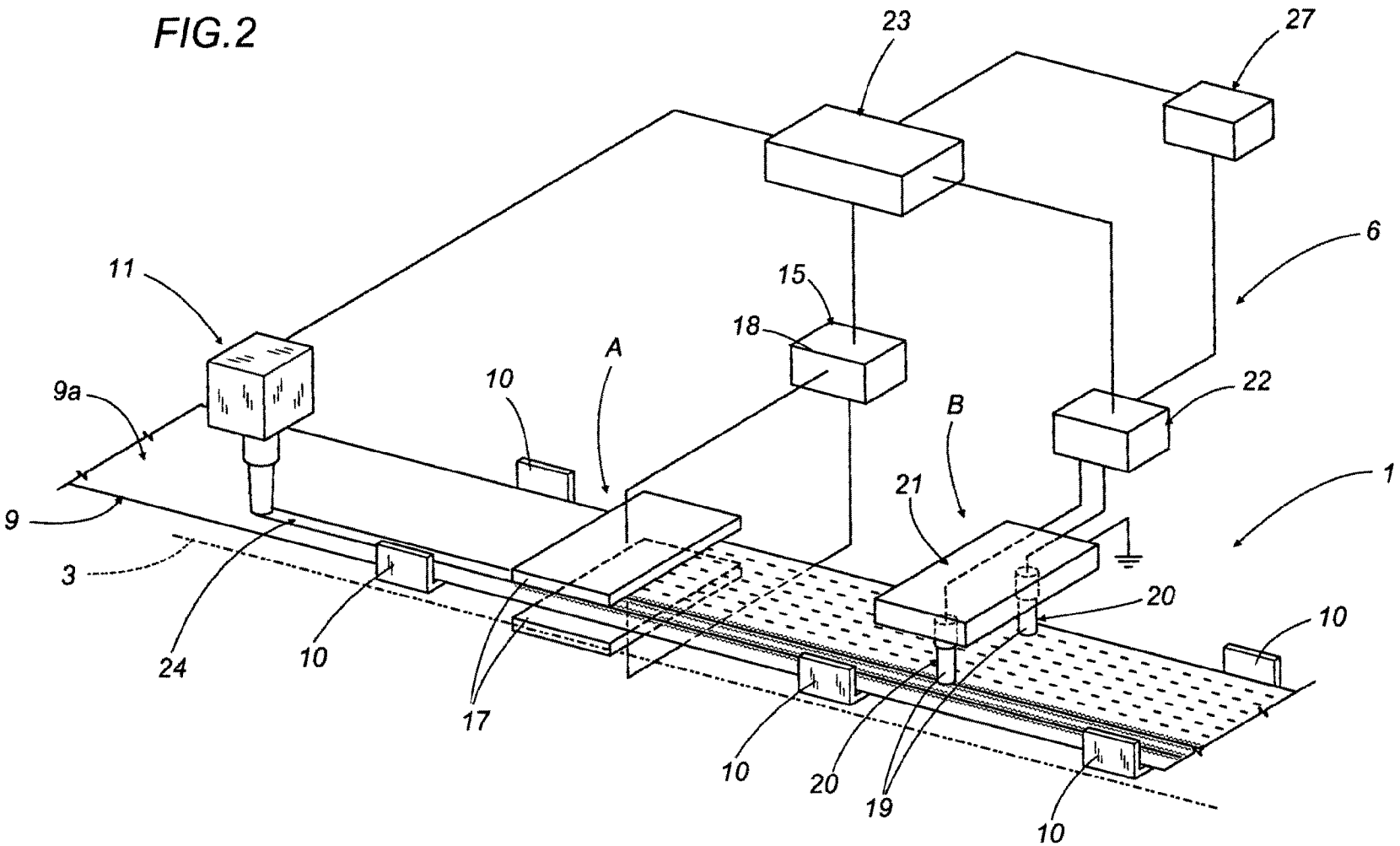
FIG. 2 shows a second embodiment of the device seen in FIG. 1, illustrated schematically and in perspective with certain parts omitted.

In FIGS. 1 and 2 of the drawings, 1 denotes a portion, in its entirety, of a packaging machine in which a wrapping material 2 is caused to advance along a feed path 3, decoiling from a roll 4 and proceeding toward a cutter device 5 by which it is divided up transversely into discrete lengths, and passing also through a checking unit denoted 6 in its entirety.

As illustrated in FIG. 1, the roll 4 is carried by a pivot 7 rotatable about a horizontal axis 7*a* and driven by a relative motor 8 in such a way that the wrapping material 2, which takes the form of a continuous strip 9, can be decoiled with the aid of conventional traction means (not illustrated) and directed between guides 10 toward a device 11 by which an accessory material, denoted 12, is applied to selected first areas of the strip 9.

The applied accessory material 12 appears in the example of FIG. 1 as a continuous succession of spots 13 occupying predetermined positions on the strip and consisting, for example, in an adhesive substance such as cold and/or hot melt glue.

In this way, downstream of the cutter device 5, each of the discrete lengths 14 separated from the strip will present a given number of spots 13 of adhesive occupying positions predeterminable by suitably timing and interlocking the operation of the applicator device 11 and the cutter device 5.

In the example of FIG. 1, proceeding upstream to downstream along the feed path 3, the checking unit 6 comprises a device 15 by means of which to charge the advancing strip 9 electrostatically, and thereafter, a device 16 by means of which to sense the electrostatic charges applied previously to the strip; the devices 15 and 16 in question coincide respectively with a first operating station A and a second operating station B.

In particular, the charging device 15 comprises a pair of plates 17 offered one to each face of the continuous strip 9 and connected to an electric field generator 18 such as will create a potential difference between the plates 17 and thus charge at least the upwardly directed face 9*a* of the strip 9 electrostatically.

Figure 6:
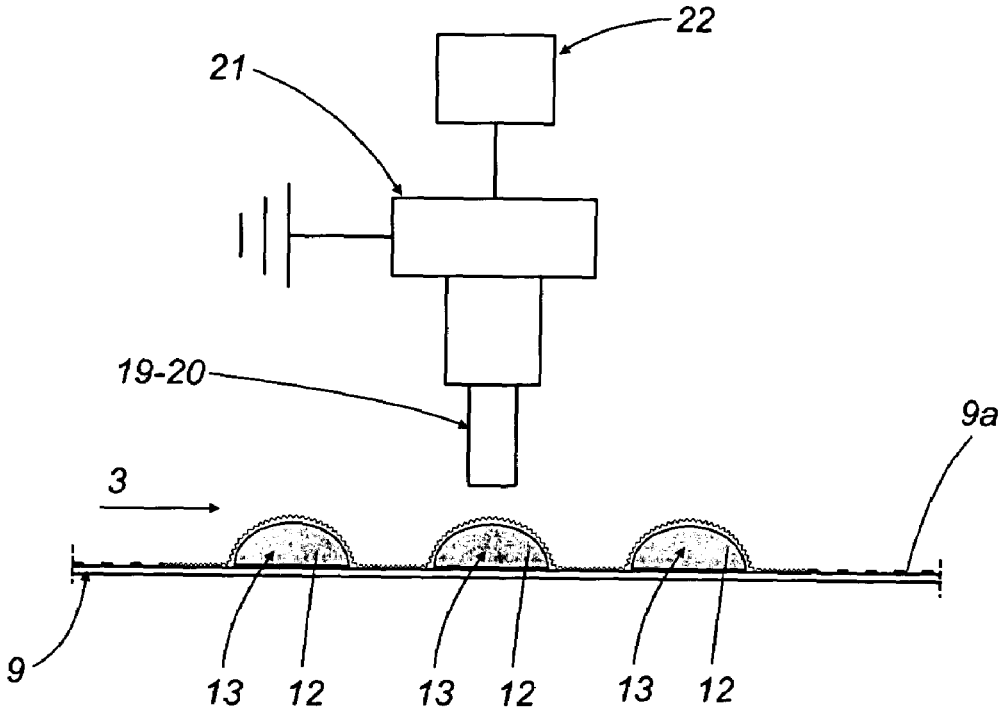
FIG. 6 is a detail of FIG. 1, shown enlarged and in a schematic side elevation view.

The sensing device 16 comprises a first sensor 19 and a second sensor 20 carried by a supporting structure 21 (see also FIG. 6) and connected to a comparator circuit indicated by a block denoted 22. The first sensor 19 is directed toward the face 9*a* of the strip 9 and aligned on the aforementioned first areas occupied by the spots 13 of adhesive, whilst the second sensor 20 is directed toward the same face 9*a* of the strip 9, though aligned on a selected second area not occupied by the accessory material 12. Observing FIG. 6, it will be seen that the structure 21 also performs the function of a screen, for reasons that will become clear in due course.

The block denoted 23 represents a master control unit to which the decoil motor 8, the applicator device 11, the electric field generator 18 and the comparator 22 are all connected.

It has been demonstrated by practical experiment that when a strip of wrapping material is exposed to the action of an electric field able to generate electrostatic charges on the surface of the strip, these will tend to accumulate and to intensify at the areas treated with accessory materials. In the particular case in point, the electrostatic charges were seen to concentrate predominantly around and upon the spots 13 of adhesive, whereas across the remainder of the face 9*a* presented by the strip 9, the distribution of the charges was typified by a lower and substantially uniform concentration.

In operation, following the step of applying the spots 13 of adhesive, the wrapping material can be checked under the sensing device 16 to verify the distribution of the electrostatic charges on the face 9*a* of the strip 9, by revealing the pattern of their concentration in the selected first areas, of greater intensity, and in the second area of lesser intensity.

In the event of the device 16 returning a signal found to be abnormal when compared with a reference signal supplied to the master control unit 23 by a generator 27, for example if there are spots 13 of adhesive missing from or not correctly positioned in the first areas, the comparator 22 will relay a signal to the control unit 23 which can then, for example, shut off the motor 8 to stop the movement of the strip 9 and pilot the applicator device 11 to restore the correct distribution of the spots 13 of adhesive.

Figure 5:
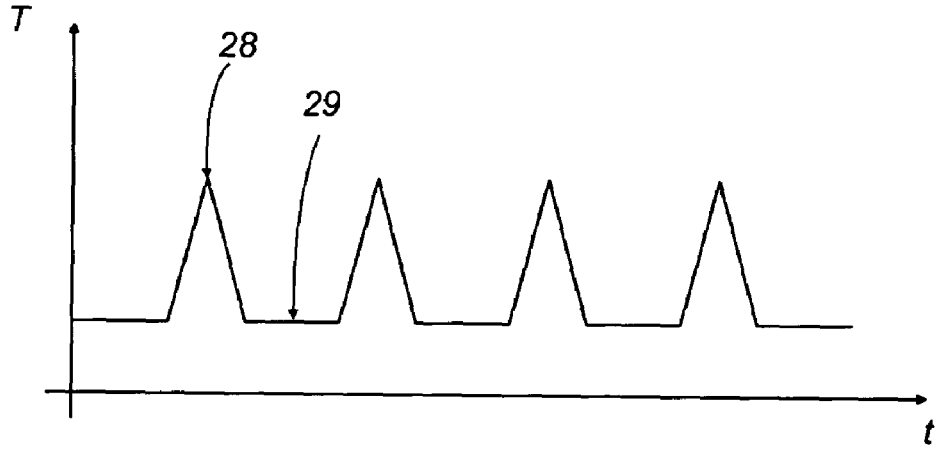
FIG. 5 is a graph illustrating a control signal relative to the device of FIG. 1.

By way of example, FIG. 5 illustrates a signal emitted typically by the first sensor 19 and the second sensor 20. In practice, the sampled signal presents a succession of peaks 28 corresponding to the spots 13 of adhesive, where the first sensor 19 detects a greater concentration of charges, whilst the second sensor 20 generates a flatline signal 29 of amplitude lower than the peaks 28, reflecting the lower concentration of charges on the remainder of the strip 9, that is, on the part of the face 9*a* where no spots 13 of adhesive are present. A signal of this type is compared with the reference signal supplied by the generator 27, the characteristics of which will be the same as in FIG. 5.

Adopting a comparative type of control using two sensors 19 and 20, it becomes possible to obtain greater accuracy and reliability from the sensing device 16. In addition, the structure 21 prevents any accumulation of charges around the sensors 19 and 20 by discharging them to earth, so that there will be no spurious signals generated.

Advantageously, the adhesive substances applied to the wrapping material can be treated in such a way as will increase their capacity to accumulate electrostatic charges, for example by including additives able to attract such charges.

The solution illustrated in FIG. 2 differs from that of FIG. 1 only inasmuch as the adhesive is distributed by the applicator device 11 along the first area in the form of a continuous fillet 24.

Figure 3:
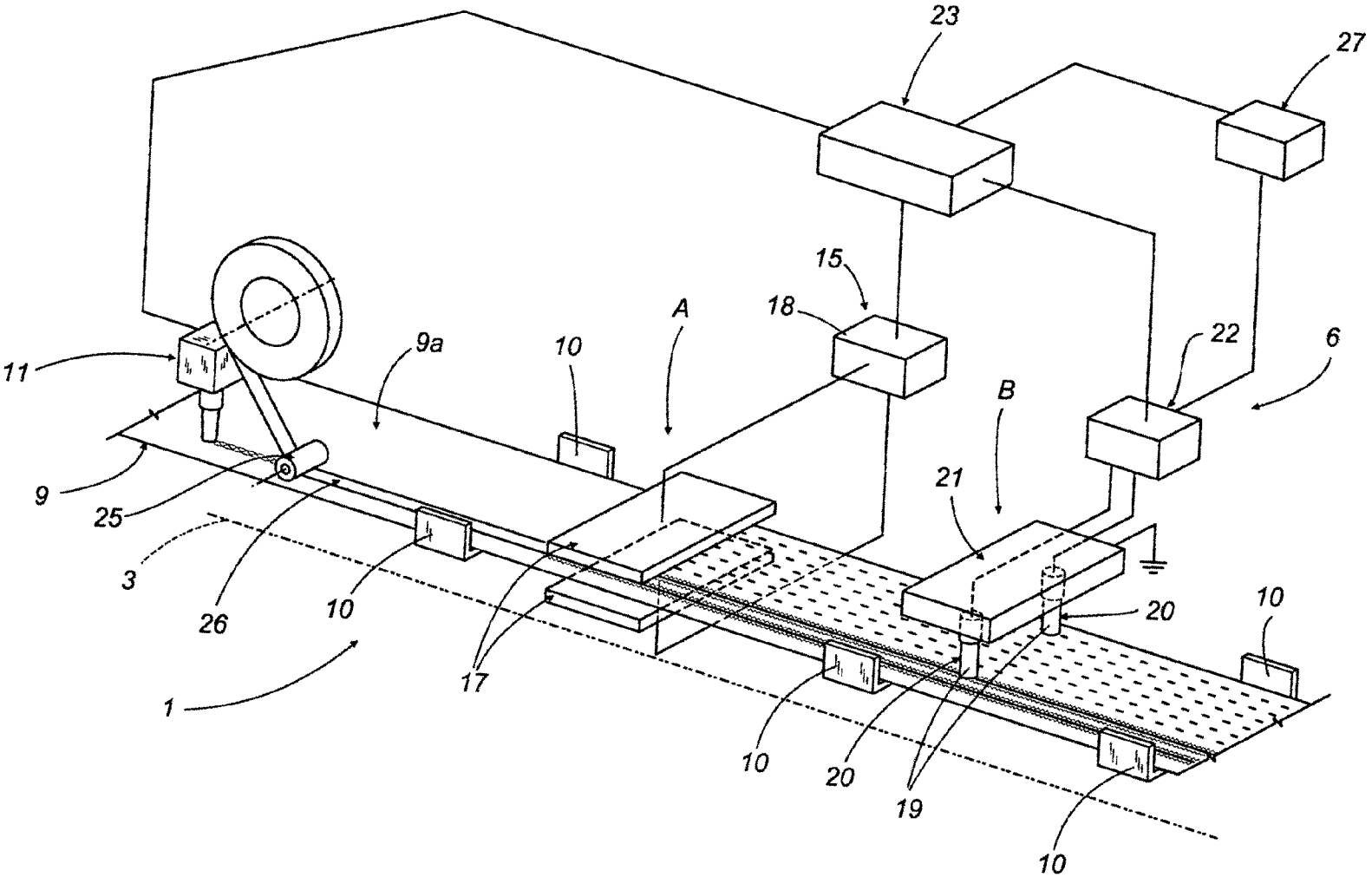
FIG. 3 shows a third embodiment of the device seen in FIG. 1, illustrated schematically and in perspective with certain parts omitted.

Similarly, the example of FIG. 3 differs from that of FIG. 2 only in that the application of a continuous fillet 24 of adhesive is followed by the application over the adhesive, utilizing a suitable pressure roller 25, of a fillet 26 identifiable as a second wrapping material consisting for example of an easy-tear ribbon designed to facilitate the operation of breaking open an overwrap on packets or cartons of cigarettes.

Figure 4:
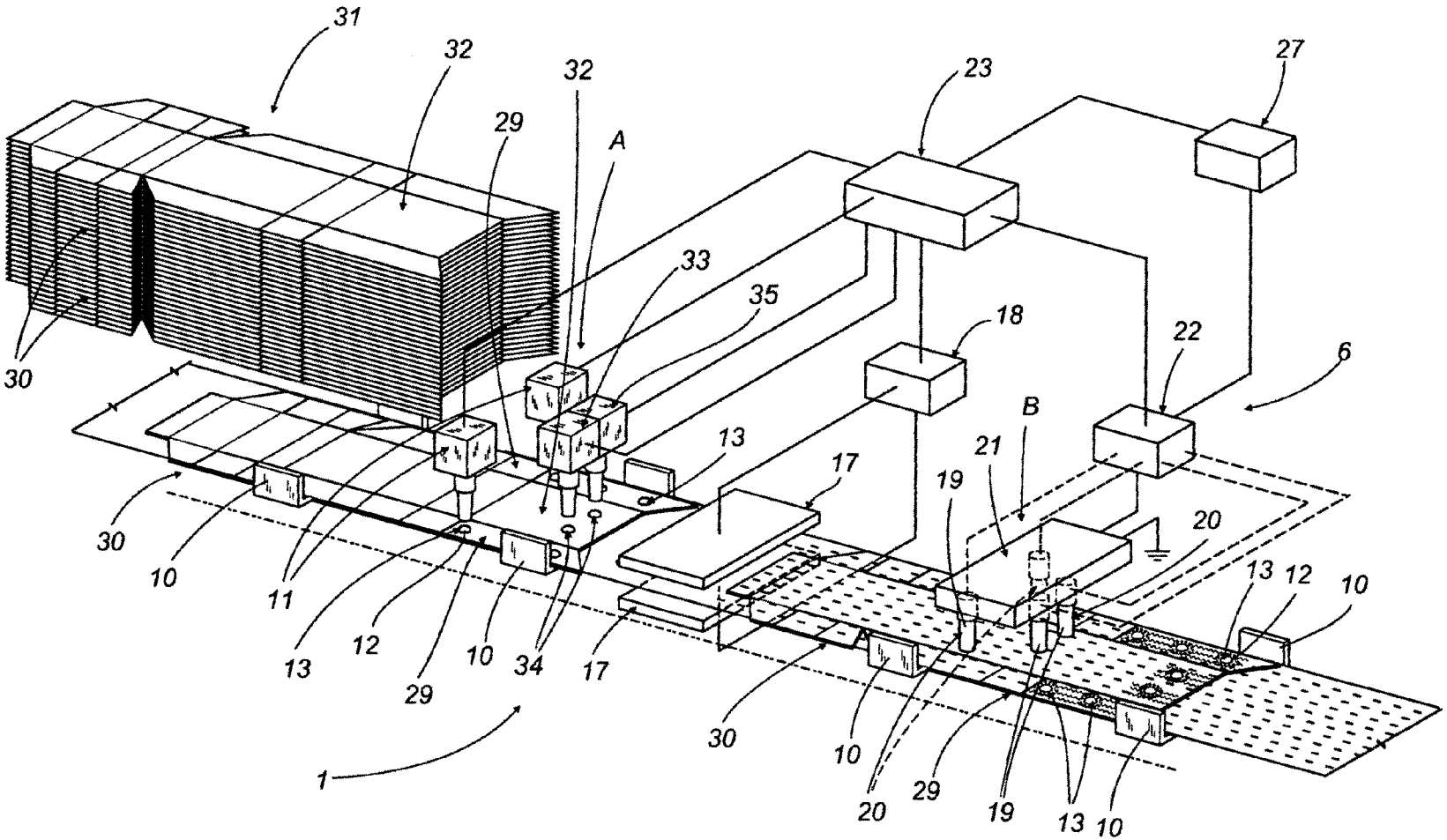
FIG. 4 shows a fourth embodiment of the device seen in FIG. 1, illustrated schematically and in perspective with certain parts omitted.

In the example of FIG. 4, spots 13 of adhesive are applied according to a predetermined layout on selected areas of the lateral portions 29 presented by flat diecut blanks 30 taken from a stack 31.

At a given point along the feed path 3 followed by the blanks 30, two applicator devices 11 are supplemented by a further device 33 operating at the first station A, such as will apply dabs 34 of adhesive to respective central portions 32 of the blanks 30, and a device 35 dispensing a metallic powder designed to cling to the adhesive dab 34.

The device and the checking method thus described are able to ensure that no defective lengths or blanks of material will reach the wrapping stations downstream, so that stoppages are prevented and rejects avoided.

The accessory material 12 is described above as an adhesive substance, by way of example, but might also consist in fluid substances such as inks or colorants.

In the case of the embodiments illustrated in FIGS. 2 and 3, moreover, the presence and correct placement of the continuous fillet 24 of accessory material 12 and the fillet 26 of second wrapping material can be verified simply by comparing the signals from the two sensors 19 and 20, and without the need for a generator 27 to supply a reference signal as in FIG. 5.

What is claimed is:

1. A method of checking wrapping material in a packaging machine, comprising the steps of:

causing the wrapping material to advance along a predetermined feed path;

applying an accessory material to selected areas of the wrapping material;

charging the wrapping material electrostatically as it passes through at least one first charging station, so that the electrostatic charges concentrate predominantly upon the accessory material, and across the remainder wrapping material, the distribution of the electrostatic charges has a lower and uniform concentration;

subsequently verifying the distribution of the electrostatic charge on the wrapping material, as it passes through at least one second checking station comprising at least two sensors, by using the two sensors to sense a variation in concentration of the electrostatic charges and reveal a greater intensity electrostatic charge concentration on the accessory material and a lesser intensity electrostatic charge concentration on the remainder wrapping material; and comparing these two values.

2. A method as In claim 1, wherein the step of sensing a variation in concentration of the electrostatic charges includes a step of generating at least one signal indicating the nature of the concentration on the wrapping material following the step of applying the accessory material.

3. A method as in claim 2, wherein the step of applying the accessory material includes the step of applying a set of spots of a fluid or powdered substance.

4. A method as in claim 3, wherein the spots of the set are ordered in a predetermined pattern.

5. A method as in claim 3, wherein the fluid substance is an adhesive substance.

6. A method as in claim 3, wherein the fluid substance is a coloring substance.

7. A method as in claim 3, wherein the fluid substance includes additives capable of attracting electrostatic charges, includes the step of applying a continuous fillet of a fluid or powdered substance.

8. A method as in claim 3, comprising a step of verifying the correct distribution and number of the spots of the fluid substance.

9. A method as in claim 2, wherein the step of applying the accessory material includes the step of applying a continuous fillet of a fluid or powdered substance.

10. A method as in claim 2, wherein the step of applying the accessory material includes the step of applying a continuous fillet of a second wrapping material.

11. A method as in claim 10, wherein the fillet of second wrapping material includes an easy tear ribbon applicable to the wrapping material.

12. A method as in claim 1, wherein the wrapping material includes a continuous strip decoiled from a relative roll and caused to advance along a predetermined path.

13. A method as in claim 12, wherein the discrete lengths of material include blanks from which to fashion hinge-lid cigarette packets, or cartons designed to contain such packets.

14. A method as in claim 1, wherein the wrapping material includes a succession of discrete lengths caused to advance along a predetermined path.

* * * * *